US005832545A

United States Patent [19]

Pan

[11] Patent Number: 5,832,545

[45] Date of Patent: Nov. 10, 1998

[54] SINK DRAIN PLUG

[76] Inventor: Chin-Chi Pan, No. 99, Sec. 3, Chang Tsao Rd., Ho Me, Changhua, Taiwan

[21] Appl. No.: 998,682

[22] Filed: Dec. 29, 1997

[51] Int. Cl.[6] ..... A47K 1/14

[52] U.S. Cl. ..... 4/293; 4/286; 4/295

[58] Field of Search ..... 4/286, 287, 293, 4/295

[56] References Cited

U.S. PATENT DOCUMENTS

| | | | |
|---|---|---|---|
| 4,926,507 | 5/1990 | Craig et al. | 4/295 |
| 5,072,461 | 12/1991 | Logsdon | 4/295 |
| 5,749,105 | 5/1998 | Bruno et al. | 4/295 |

*Primary Examiner*—Charles E. Phillips
*Attorney, Agent, or Firm*—W. Wayne Liauh

[57] ABSTRACT

A sink drain plug is composed of a main body, a cover body, a center rod, a pull head, and an elastic wire body. The main body is fastened with a sink or lavatory. The cover body is located on the top of the main body and is provided with a hollow column extending from the underside thereof. The center rod is fitted into the hollow column such that the center rod is fastened at the bottom end thereof with the bottom end of the main body. The pull head is fastened with the top of the cover body. The elastic wire body is engaged with the center rod such that two lugs of the elastic wire body are jutted out of the center rod to urge the inside of the hollow column so as to locate securely the cover body at a level at which the main body is opened or closed.

4 Claims, 7 Drawing Sheets

SINK DRAIN PLUG

FIELD OF THE INVENTION

The present invention relates generally to a sink drain plug, and more particularly to a sink drain plug consisting of a center rod which is simple in construction and can be made and replaced economically.

BACKGROUND OF THE INVENTION

As shown in FIGS. 1 and 2, a sink drain plug of the prior art comprises a main body 1, a center rod 2, a cover body 3, and a pull head 4. The main body 1 is mounted in a sink or lavatory and is provided in the underside thereof with a plurality of ribs 11 and a threaded hole 12. The center rod 2 is put into a hollow column 32 extending from the cover body 3 via a stepped hole 31 of the cover body 3 such that the center rod 2 is fastened at the bottom end thereof with the threaded hole 12 of the main body 1. The center rod is provided at the top end thereof with a stepped portion 21, which is engaged with the stepped hole 31 of the cover body 3. The cover body 3 is further provided with a water seal 33. The pull head 4 is provided with a receiving cell 41 and is fastened with the cover body 3. The center rod 2 is provided therein with a spring 22 located horizontally such that one end of the spring 22 urges the inside of the center rod 2, and that another end of the spring 22 urges a steel ball 23 which is partially exposed, as shown in FIG. 2. When the cover body 3 is caused by an external force to move up and down, the hollow column 32 of the cover body 3 is also caused to move up and down along the center rod 2 such that the steel ball 23 is urged by the hollow column 32 to retract to urge the spring 22. As soon as the hollow column 32 stops moving, the elastic force of the compressed spring 22 is so released as to push the steel ball 23 outwards to urge the inside of the hollow column 32, thereby holding securely the cover body 3 at a level at which the main body 1 is opened or closed. When the main body 1 is closed, the top of the main body 1 is urged by the water seal 33 of the cover body 3. The main body 1 of the sink drain plug of the prior art is effective in closing or opening the sink drain. However, the sink drain plug of the prior art has shortcomings, which are described explicitly hereinafter.

In the process of making the center rod 2, the spring 22 must be first located in a hole of the center rod 2 before the steel ball 23 is located in the hole such that the inner side of the steel ball 23 is urged by the spring 22. Thereafter, two opposite portions of the hole edge are punched and pressed such that the outer diameter of the hole becomes smaller than the radius of the steel ball 23, so as to locate the steel ball 23 securely inside the hole of the center rod 2 in such a manner that the steel ball 23 is partially exposed. Such a process of making the center rod 2 is rather complicated and expensive in view of the fact that the spring 22 and the steel ball 23 must be located in the hole of the center rod 2 with precision, and that the entire process of making the center rod 2 must be carried out manually. In other words, the process of making the center rod 2 is not cost-effective.

The spring 22 is urged by the steel ball 23 which is in turn urged by the hollow column 32 of the cover body 3. As a result, when the steel ball 23 is under pressure, the steel ball 23 is not in an intimate association with the hole, thereby resulting in the unwanted entry of impurities into the hole. The spring 22 is eventually hampered by the impurities such that the spring 22 can not be compressed or decompressed, and that the steel ball 23 can therefore no longer be urged by the spring 22 to push the hollow column 32 of the cover body 3 at such time when the cover body 3 is lifted. As a result, the cover body 3 can not be located securely at its opening position or closing position. The function of the sink drain plug of the prior art is thus seriously hampered.

Upon completion of locating the steel ball 23 in the hole of the center rod 2, the hole edge is punched and pressed such that the hole diameter is made smaller so as to located the steel ball 23 securely in the hole of the center rod 2. As a result, the rusty spring 22 and the rusty steel ball 23 can not be replaced. It is therefore necessary to replace the center rod 2 when the spring 22 and the steel ball 23 are disabled.

SUMMARY OF THE INVENTION

The primary objective of the present invention is therefore to provide a sink drain plug free from the drawbacks of the sink drain plug of the prior art described above.

In keeping with the principle of the present invention, the foregoing objective of the present invention is attained by the sink drain plug which is composed of a main body, a cover body, a center rod, a pull head, and an elastic wire body. The main body is mounted in a sink or lavatory such that the cover body is located at the top of the main body. The cover body is provided with a hollow column extending from the underside of the cover body such that the hollow column is engaged with the center rod which is fastened at the bottom end thereof with the bottom end of the main body. The pull head is fastened with the top of the cover body. The center rod is provided with the elastic wire body having two lugs which are jutted out of the center rod to urge the hollow column of the cover body so as to enable the cover body to locate securely at its opening position or closing position. The process of making the center rod is thus simplified to the extent that the process is very cost-effective. In addition, a disabled elastic body of the present invention can be replaced with a new one, without having to replace the entire center rod.

The foregoing objective, features, functions, and advantages of the present invention will be more readily understood upon a thoughtful deliberation of the following detailed description of a preferred embodiment of the present invention with reference to the accompanying drawings.

DETAILED DESCRIPTION OF THE EMBODIMENT

Figure 1:
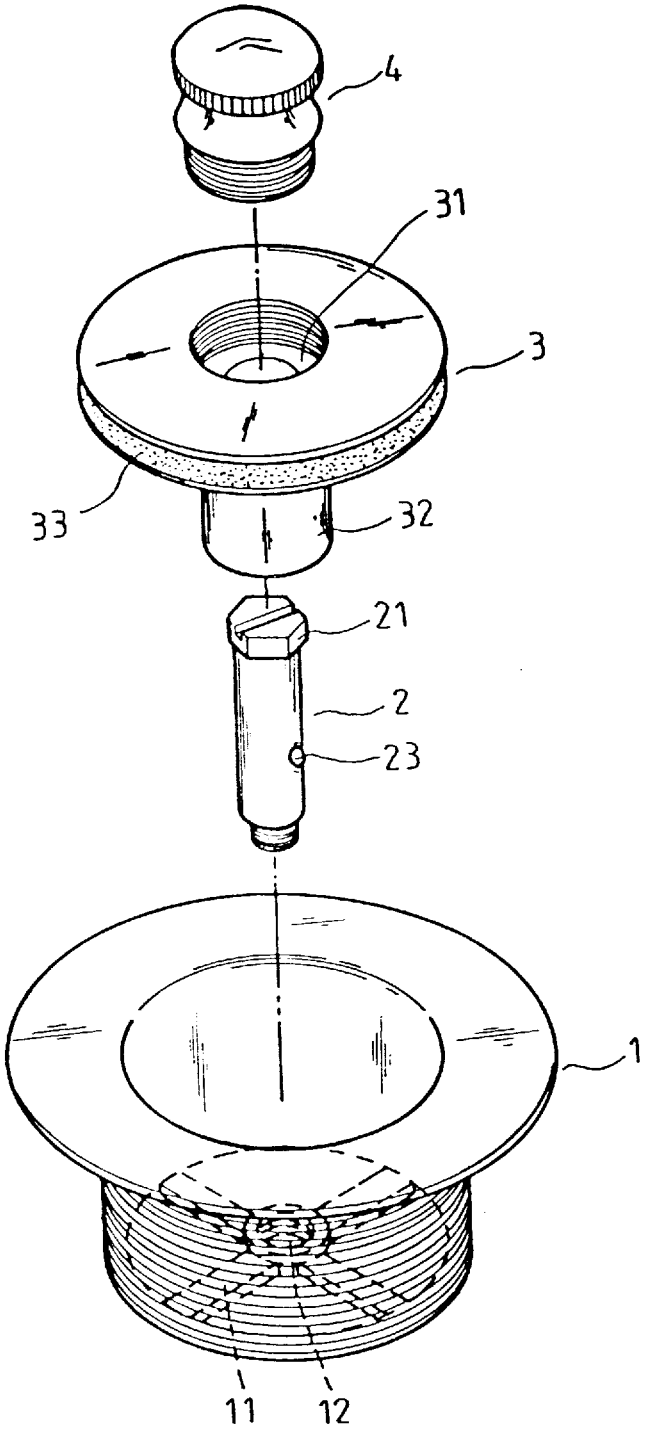
Fig. 1 PRIOR ART
FIG. 1 shows an exploded view of a sink drain plug of the prior art.
Figure 2:
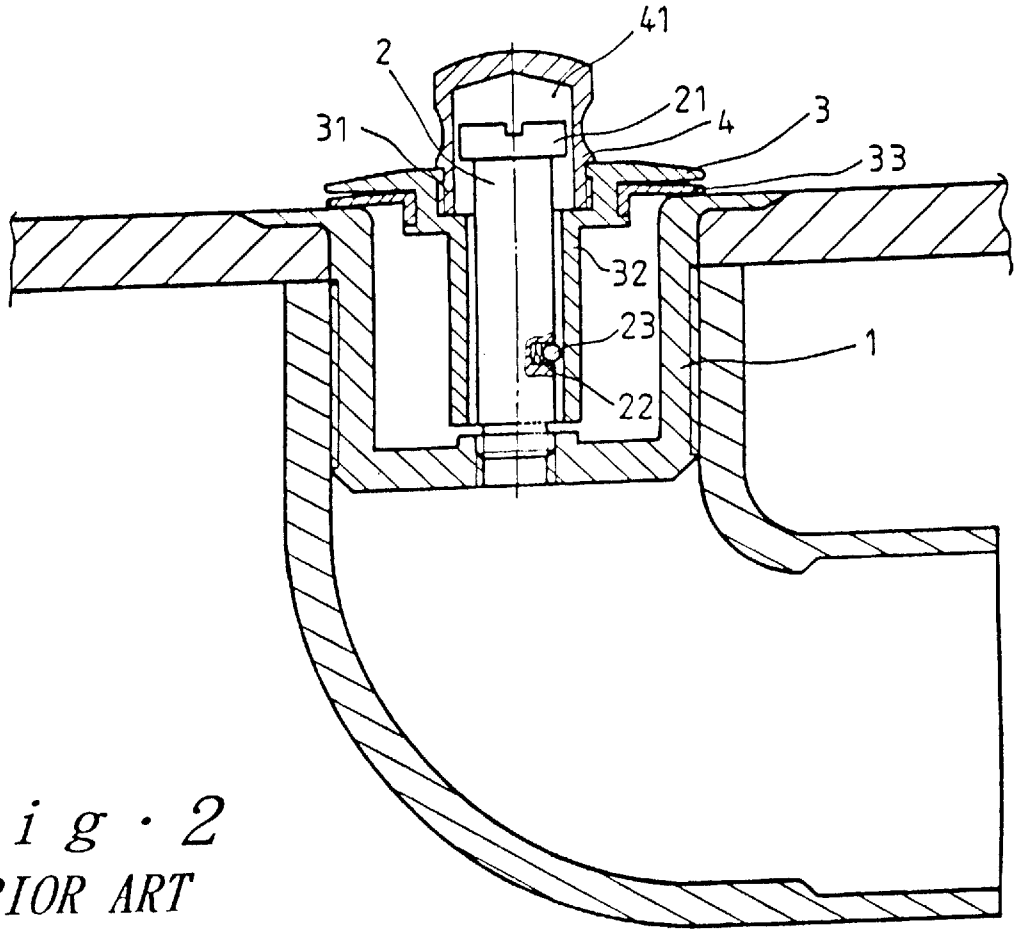
Fig. 2 PRIOR ART
FIG. 2 shows a sectional schematic view of the prior art drain plug in combination.
Figure 3:
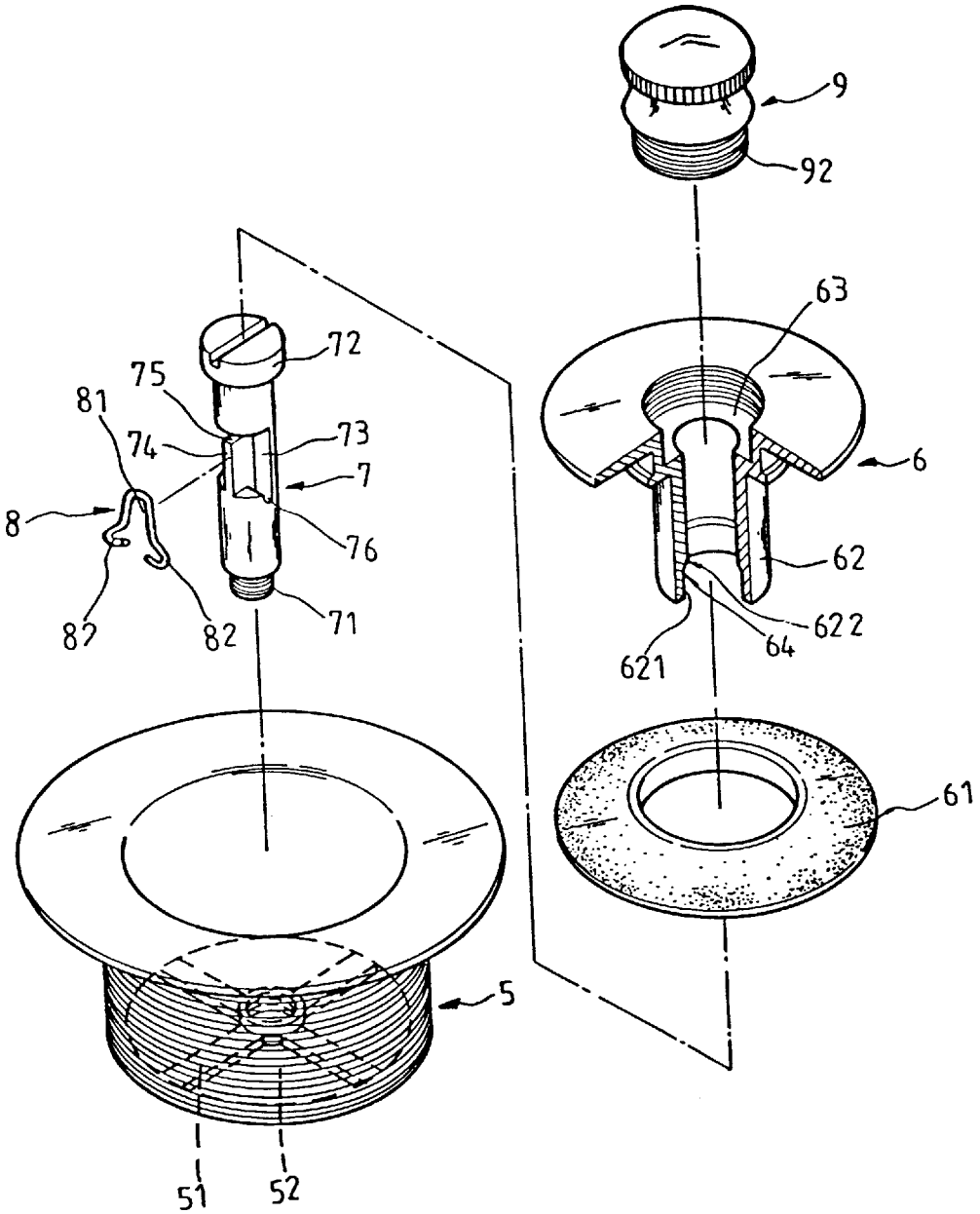
FIG. 3 shows an exploded view of a sink drain plug of the preferred embodiment of the present invention.

As shown in FIG. 3, a sink drain plug embodied in the present invention is composed of a main body 5, a cover body 6, a center rod 7, an elastic wire body 8, and a pull head 9.

The main body 5 is a hollow base body and is provided with a plurality of ribs 51 and a threaded hole 52, which are located in the underside of the main body 5.

The cover body 6 has a water seal 61 and a hollow column 62 extending from the underside of the cover body 6. The hollow column 62 is provided in the vicinity of the bottom end thereof with a through hole 621 having a greater hole diameter than that of the column 62. Located at the junction of the inside of the hollow column 62 and the through hole 621 is an inverted angle 622. The cover body 6 is further provided with a stepped hole 63 in communication with the hollow column 62.

The center rod 7 is provided at the bottom end thereof with a threaded portion 71, and at the top end thereof with a stepped portion 72. The center rod 7 is further provided in the midsegment thereof with two slots 73 opposite in location to and coplanar with each other, a bracing piece 74 located between the two slots 73, an indentation 75 located between the top end of the bracing piece 74 and the tops of the slots 73, and a position restricting slot 76 extending downwards from the side of the slot 73.

The elastic wire body 8 is provided at the midsegment thereof with a curved insertion portion 81, and at each of both ends thereof with a lug 82.

The pull head 9 is provided therein with a receiving cell 91 and is further provided in the underside thereof with a threaded portion 92.

Figure 4:
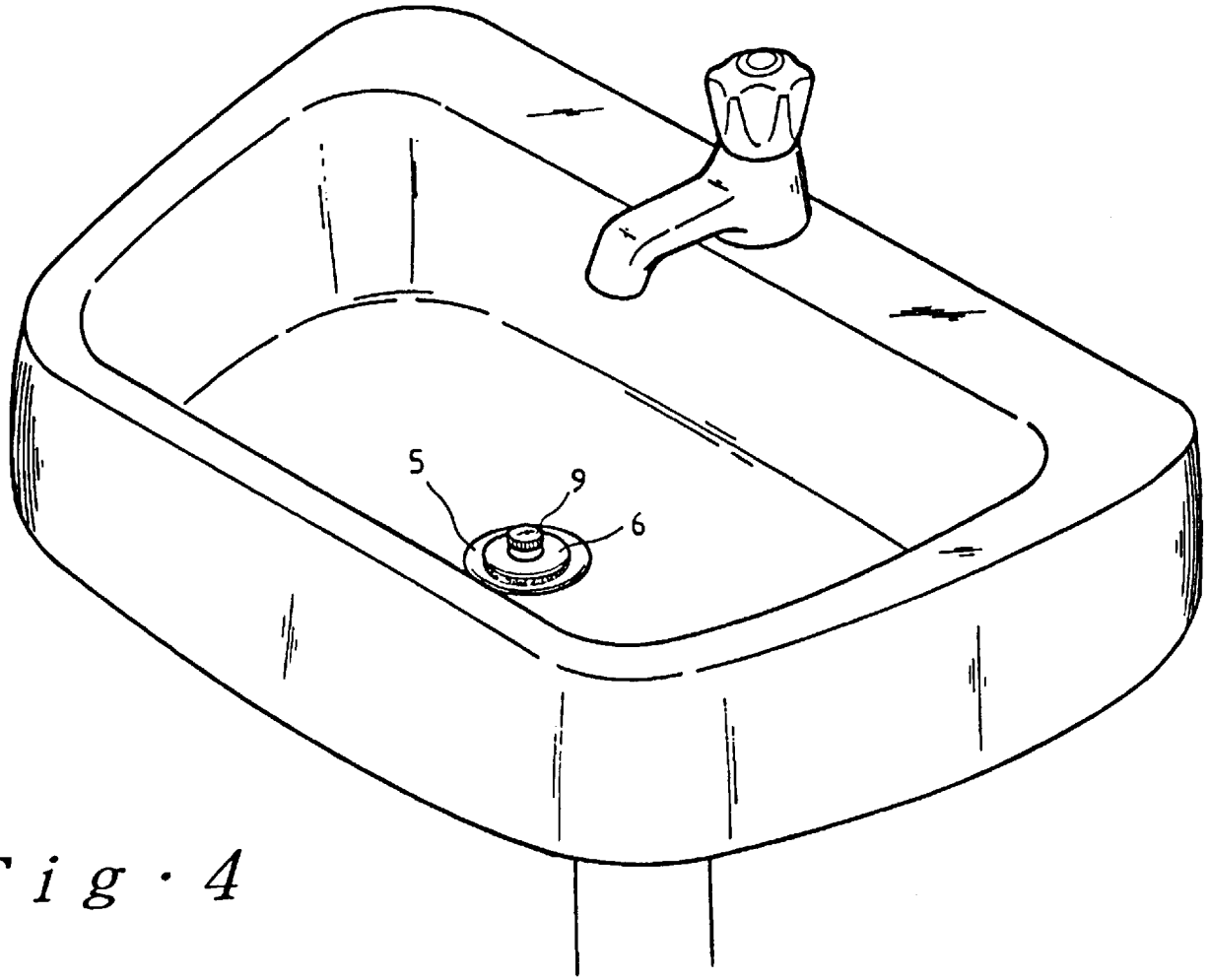
FIG. 4 shows a schematic view of the sink drain plug of the present invention in combination with a sink or lavatory.
Figure 5:
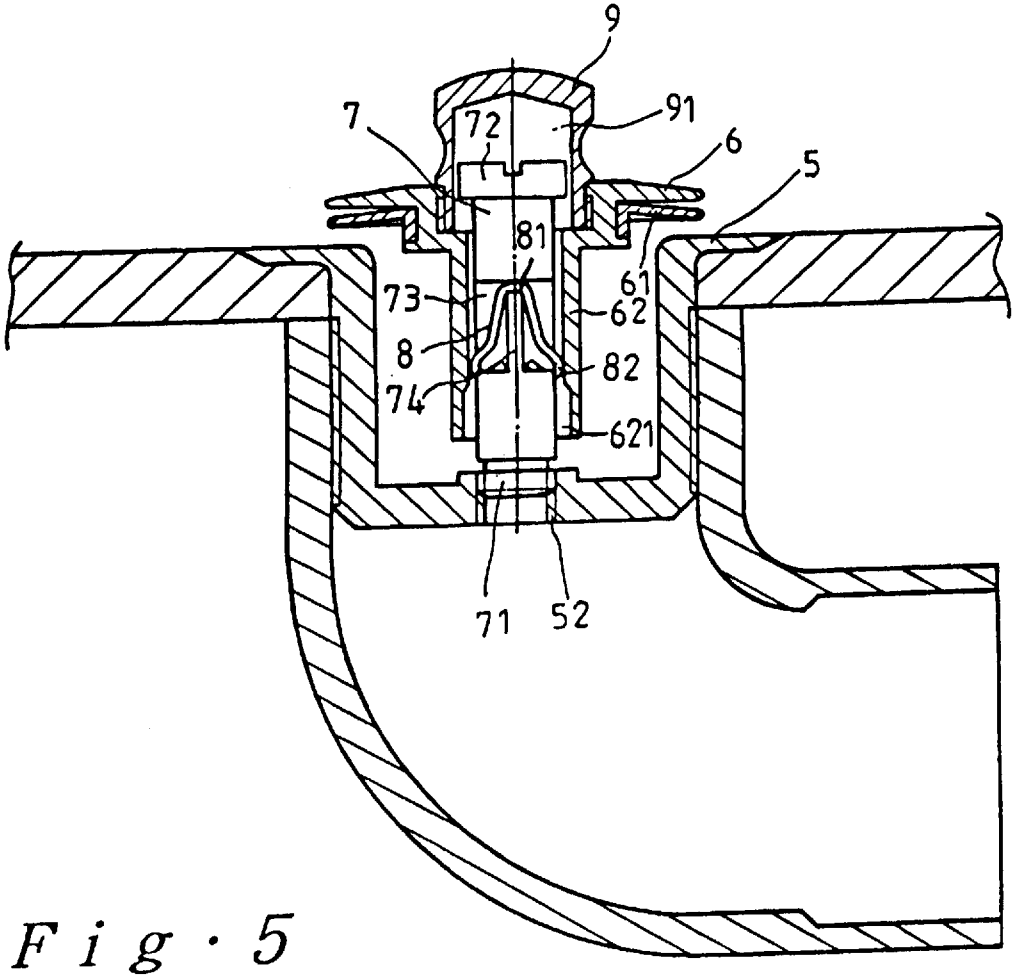
FIG. 5 shows a sectional view of the present invention in combination with the sink or lavatory as shown in FIG. 4.

As shown in FIGS. 4 and 5, the elastic wire body 8 is engaged with the center rod 7 such that the insertion portion 81 of the elastic wire body 8 is retained in the indentation 75 of the center rod 7, and that the elastic wire body 8 is further held securely by a clamping piece 64, and further that both ends of the elastic wire body 8 are located in the slots 73 of the center rod 7, and still further that the lugs 82 of the elastic wire body 8 are located in the position restricting slot 76 in such a manner that the lugs 82 are jutted out of the center rod 7. In the meantime, the center rod 7 is received in the hollow column 62 of the cover body 6. The lugs 82 are urged by the hollow column 62. The stepped portion 72 of the center rod 7 is engaged with the stepped hole 63 of the cover body 6 for confining the upward movement of the cover body 6. The cover body 6 is located on the top of the main body 5 such that the threaded portion 71 of the center rod 7 is engaged with the threaded hole 52 of the main body 5. The water seal 61 of the cover body 6 is retained on the top of the main body 5 for confining the downward movement of the cover body 6. The cover body 6 is engaged at the top thereof with the threaded portion 92 of the pull head 9 such that the cover body 6 can be actuated by the pull head 9.

Figure 6:
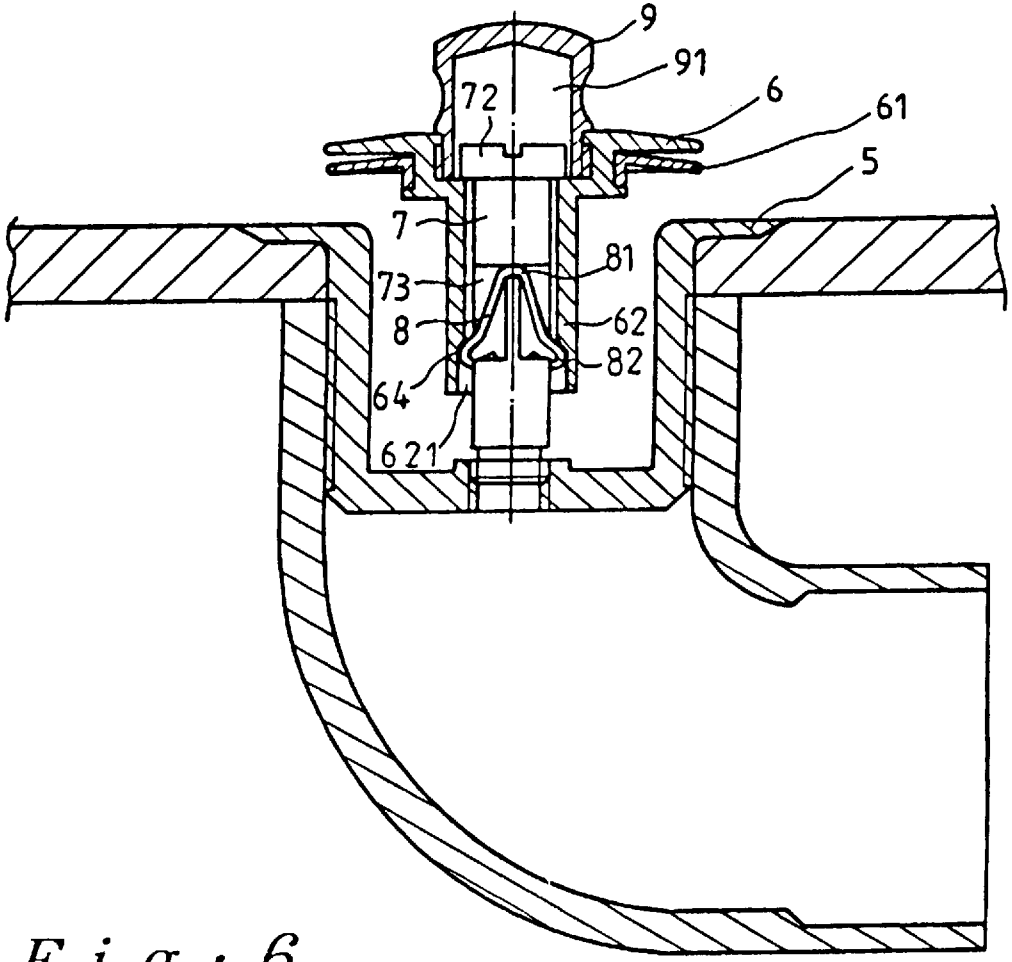
FIG. 6 shows a schematic view of the present invention at work.

As shown in FIG. 6, when the pull head 9 is pulled such that the cover body 6 is actuated by the pull head 9 to move upward to become disengaged with the top of the main body 5. Since the center rod 7 remains stationary, the hollow column 62 of the cover body 6 is caused to move upward along the center rod 7 until such time when the through hole 621 is opposite in location to the lugs 82, the lugs 82 are released and urged by the junction 64 of the through hole 621 and the hollow column 62. In the meantime, the stepped hole 63 of the cover body 6 is engaged with the stepped portion 72 of the center rod 7 such that the hollow column 62 is kept at a level, and that the cover body 6 is located at a level at which the main body 5 is opened.

Figure 7:
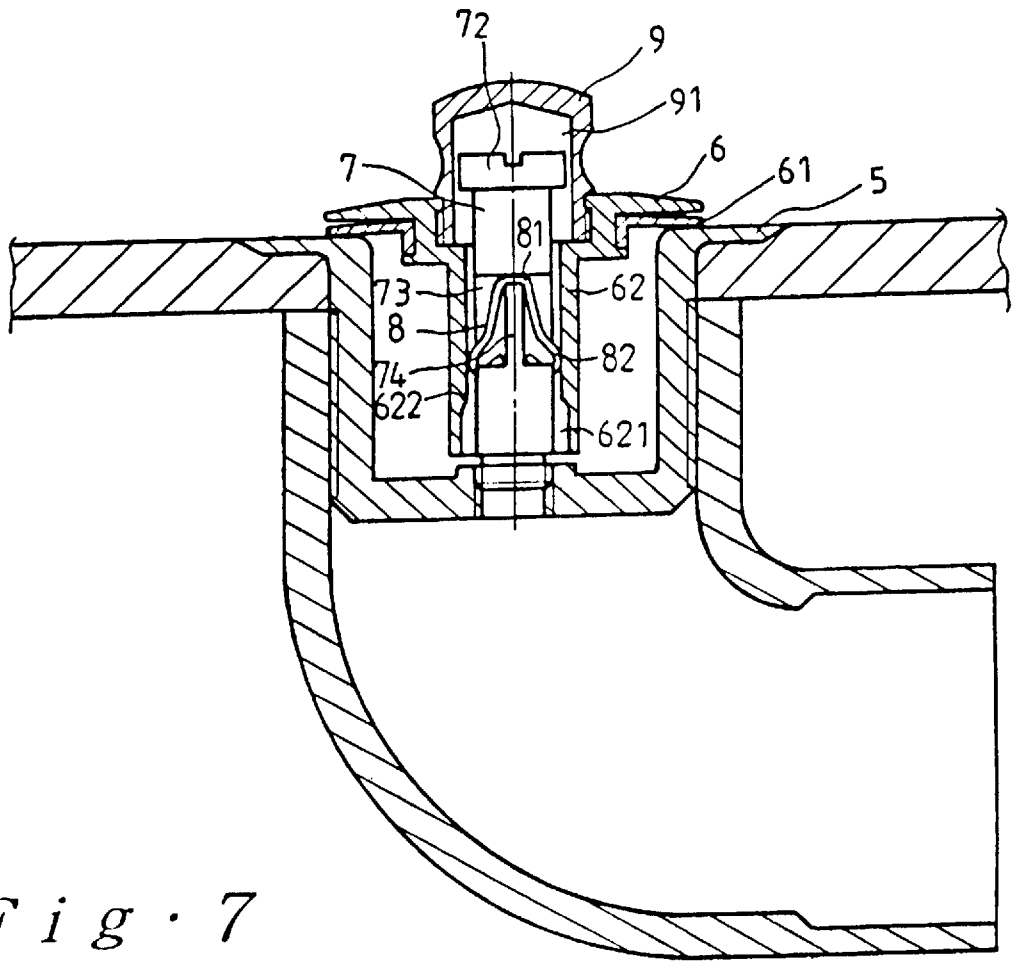
FIG. 7 shows another schematic view of the present invention at work.

Now referring to FIG. 7, when the pull head 9 is pressed by an external force such that the cover body 6 is actuated to move downward, the hollow column 62 of the cover body 6 is caused to move downward along the center rod 7. In view of the inverted angle 622 located at the junction 64, the lugs 82 are forced to move along the inverted angle 622 into the inside of the hollow column 62. The cover body 6 stops moving downward as soon as the water seal 61 is retained at the top of the main body 5. As a result, the cover body 6 is located at a level at which the main body 5 is closed. It must be noted here that the top end of the center rod 7 is received in the receiving cell 91 of the pull head 9 at such time when the cover body 6 is caused to move downward.

It is therefore readily apparent that the sink drain plug of the present invention has several advantages, which are described explicitly hereinafter.

The cover body of the present invention is located at the opening or closing position by means of the lugs of the elastic wire body which is engaged with the center rod. The elastic wire body and the center rod are made separately. The process of making the center rod is thus simplified to bring about a significant reduction in the production cost.

The elastic wire body is retained in the center rod such that the elastic wire body is held by the bracing piece, and that the lugs of the elastic wire body are located in the position restricting slot. As a result, the damaged elastic wire body can be replaced with a new one, without having to replace the center rod.

The cover body can be securely located at its opening position in view of the fact that the cover body is securely located by the lugs of the elastic wire body in such a manner that the lugs urge the inside of the hollow column of the cover body and the junction of the through hole. In other words, the sink drain plug of the present invention works each time as expected.

The embodiment of the present invention described above is to be deemed in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. A sink drain plug comprising:

a main body of a hollow construction and mounted in a sink or lavatory, said main body provided in an underside thereof with a plurality of ribs and a threaded hole;

a cover body located on a top of said main body and provided with a water seal and a hollow column extending from an underside thereof, said cover body further provided with a stepped hole in communication with said hollow column;

a center rod fitted into said hollow column of said cover body and provided at a bottom end thereof with a threaded portion which is engaged with said threaded hole of said main body, said center rod further provided at a top end thereof with a stepped portion which is retained in said stepped hole of said cover body;

a pull head provided therein with a receiving cell, and in a bottom thereof with a threaded portion fastened over said stepped hole of said cover body;

said center rod provided in a midsegment thereof with two slots opposite in location to and coplanar with each other, a bracing piece located between said two slots, and an indentation located between a top end of said bracing piece and a top surface of said slots;

an elastic wire body provided at a midsegment thereof with an insertion portion retained in said indentation of said center rod such that said elastic wire body is located securely by said bracing piece, and that two ends of said elastic wire body are located in said two slots of said center rod, and further that two lugs of said two ends of said elastic wire body are jutted out of said center rod.

2. The sink drain plug as defined in claim 1, wherein said hollow column of said cover body is provided at a bottom end thereof with a through hole having a greater hole diameter.

3. The sink drain plug as defined in claim 2, wherein an inside of said hollow column and said through hole of said cover body are provided with a junction having an inverted angle.

4. The sink drain plug as defined in claim 1, wherein said center rod is provided with a position restricting slot located beside said slots and extending downward.

* * * * *